US007311545B2

(12) United States Patent
Wu

(10) Patent No.: US 7,311,545 B2
(45) Date of Patent: Dec. 25, 2007

(54) CABLE END CONNECTOR ASSEMBLY HAVING LOCKING MEMBER

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/323,538

(22) Filed: Dec. 30, 2005

(65) Prior Publication Data

US 2006/0110971 A1 May 25, 2006

Related U.S. Application Data

(63) Continuation-in-part of application No. 10/787,661, filed on Feb. 25, 2004, now Pat. No. 6,991,487.

(51) Int. Cl.
*H01R 13/627* (2006.01)

(52) U.S. Cl. ..... 439/358

(58) Field of Classification Search ..... 439/351, 439/352, 353, 354, 355, 356, 357, 358, 555, 439/557

See application file for complete search history.

(56) References Cited

U.S. PATENT DOCUMENTS 5,083,929 A * 1/1992 Dalton ..... 439/98
5,213,533 A 5/1993 Walden
5,727,963 A 3/1998 Lemaster
5,775,931 A 7/1998 Jones
5,860,826 A 1/1999 Chang
5,941,726 A 8/1999 Koegel et al.
6,099,339 A 8/2000 Yanagida et al.
6,210,202 B1 4/2001 Kuo
6,361,363 B1 * 3/2002 Hwang ..... 439/555
6,558,183 B1 5/2003 Ji et al.
6,565,383 B1 5/2003 Wu
6,585,536 B1 7/2003 Wu
6,585,537 B1 7/2003 Lee
6,786,755 B2 9/2004 Dambach et al.
6,890,189 B1 * 5/2005 Wu ..... 439/76.1
2004/0023546 A1 * 2/2004 Wu ..... 439/352

* cited by examiner

*Primary Examiner*—Chandrika Prasad
(74) *Attorney, Agent, or Firm*—Wei Te Chung

(57) ABSTRACT

A cable end connector assembly (1) comprises an insulative housing (10), a plurality of contacts (20) received in the insulative housing, a plurality of cables (40) comprising a plurality of conductors (43, 44) electrically connecting with corresponding contacts, a pair of covers (50) assembled on the rear portion of the housing and enclosing front portions of the cables together, and a pair of locking members (60). The insulative housing defines a first retention cavity (111); The covers together defines a pair of U-shaped second retention cavities (55) therein, respectively, the first retention cavities aligned with the corresponding second retention cavities in a front-to-back direction; the locking members received in the second retention cavities of the covers and extending into the first retention cavities of the housing, each locking members comprising a spring section (63), the spring section is movable received in the second retention cavities. The covers are engaged together by a plurality of screws (53).

16 Claims, 11 Drawing Sheets

CABLE END CONNECTOR ASSEMBLY HAVING LOCKING MEMBER

CROSS-REFERENCE

This is continuing-in-part of U.S. patent application Ser. No. 10/787,661 filed on Feb. 25, 2004 now U.S. Pat. No. 6,991,487 and entitled "CABLE CONNECTOR ASSEMBLY HAVING LOCKING MEMBER" which have the same applicant and assignee as the present invention.

BACKGROUND OF THE INVENTION

1. Field of the Invention

The present invention relates to a cable end connector assembly, and particularly to a cable end connector assembly having a locking member for locking with a complementary connector.

2. Description of Prior Arts

There exists in the art a cable end connector assembly known as a Serial Advanced Technology Attachment (Serial ATA) connector which is generally used for disk drives and storage peripherals. Especially, the Serial ATA connectors according to the Serial ATA standard are featured in fewer electrical contacts than other conventional electrical connectors and are relatively tiny in configuration. It is desirable for the Serial ATA connector to have latch means for providing a reliable mechanical and electrical connection with a complementary connector.

With the development of the Serial ATA standard, the next-generation serial storage interface effort expands the base Serial ATA 1.0 capabilities to address additional markets segments, including the server and networked storage markets. A cable end connector assembly based on Serial ATA II standard is designed to connect with more devices and cables. As the connector is probably applied to a wider profile, the locking member of the Serial ATA connector disclosed in the above-mentioned is not suitable.

For resolving above problem, an electrical connector with a pair of locking members assembled there with is disclosed, each comprises a middle portion retained on a connector housing, a pushing portion extending rearwardly from the middle portion, and a locking tab extending forwardly from the middle portion. The electrical connector further comprises a housing, a cover and a plurality of terminals. The cover is over-molded with the housing. Furthermore, the cover is also can be assembled on the housing for separating from the electrical connector easily.

So, a cable end connector assembly having an improved locking member is desired.

SUMMARY OF THE INVENTION

An object of the present invention is to provide a cable end connector assembly having an improved locking member for locking the cable end connector assembly with a complementary connector.

To achieve the above object, a cable end connector assembly in accordance with the present invention comprises an insulative housing, a plurality of contacts received in the insulative housing, a plurality of cables comprising a plurality of conductors electrically connecting with corresponding contacts, a pair of covers assembled on the rear portion of the housing and enclosing front portions of the cables together, and a pair of locking members. The insulative housing defines a forwardly extending mating port with a pair of opposite side portions by two sides thereof, each of said side portions defining a first retention cavity; each cover defines a pair of opposite side portions with a pair of U-shaped second retention cavities therein, respectively, the first retention cavities aligned with the corresponding second retention cavities in a front-to-back direction; the locking members received in the second retention cavities of the covers and extending into the first retention cavities of the housing, each locking members comprising a spring section and a latching section, the spring section is movable received in the second retention cavities; the covers are engaged together by a plurality of screws.

Other objects, advantages and novel features of the invention will become more apparent from the following detailed description of the present embodiment when taken in conjunction with the accompanying drawings.

DETAILED *DESCRIPTION OF THE PREFERRED EMBODIMENT

Figure 1:
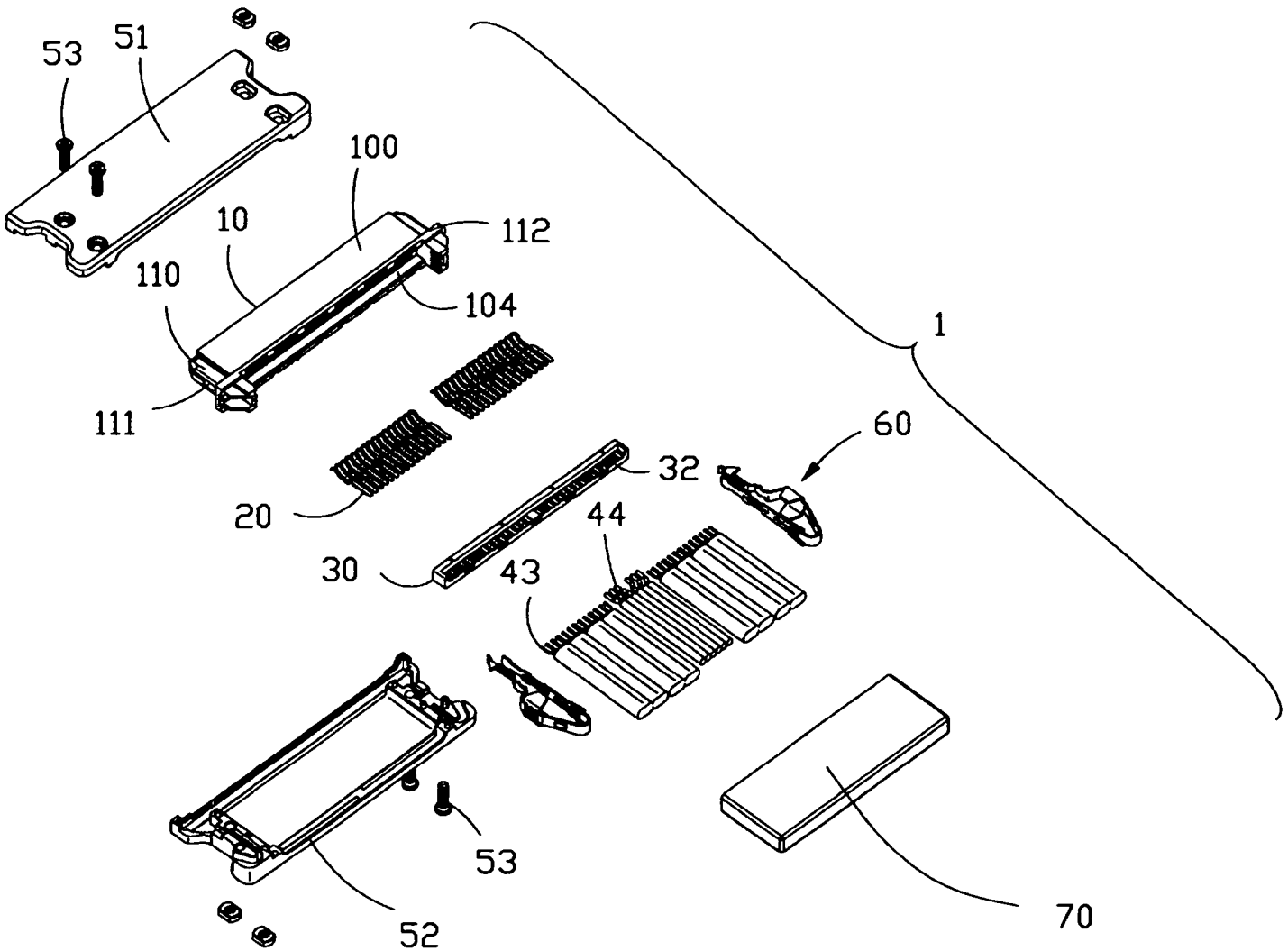
FIG. 1 is an exploded, perspective view of a cable end connector assembly in accordance with the present invention.

Referring to FIGS. 1 to 4, a cable end connector assembly 1 in accordance with the present invention comprises an insulative housing 10, a plurality of contacts 20, a spacer 30, a plurality of cables 40, a cover 50 and a pair of locking members 60. In a preferred embodiment, the cable end connector assembly 1 is in accordance with a Serial ATA II standard. However, in alternative embodiments, the electrical connector could be provided as other types.

Figure 2:
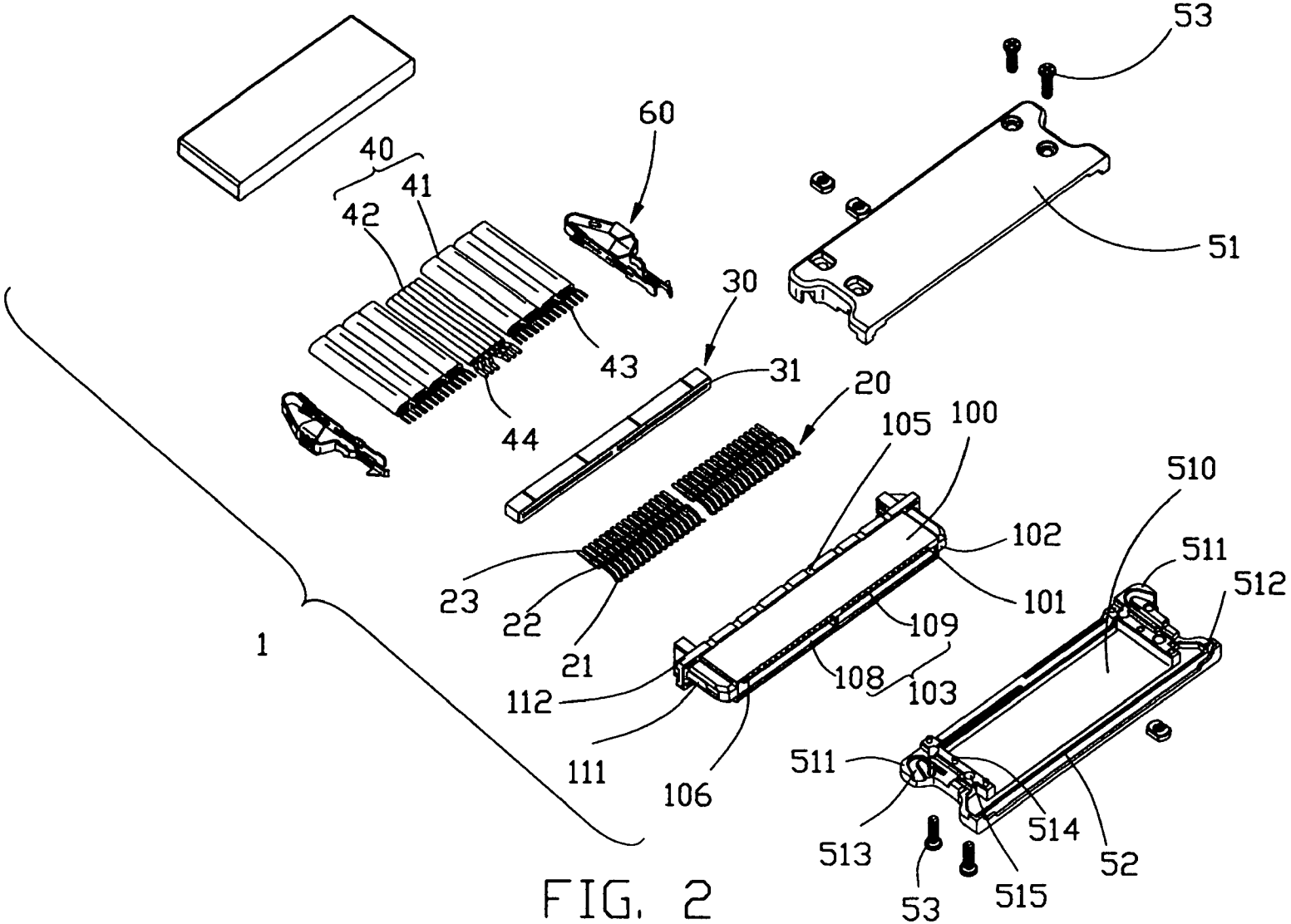
FIG. 2 is an exploded, perspective view of FIG. 1, but taken from a different aspect.
Figure 3:
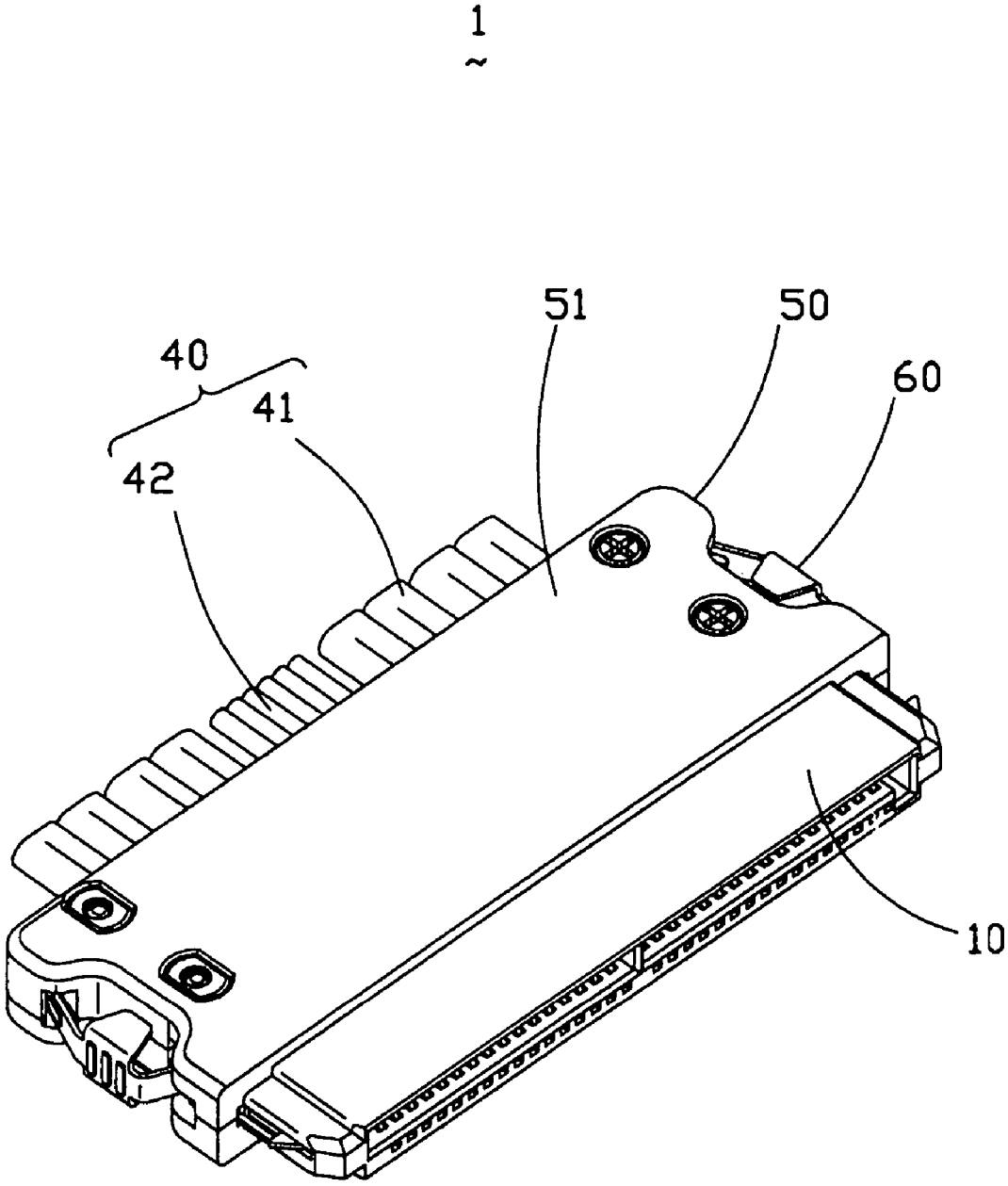
FIG. 3 is an assembled, perspective view of the cable end connector assembly of FIG. 1.
Figure 4:
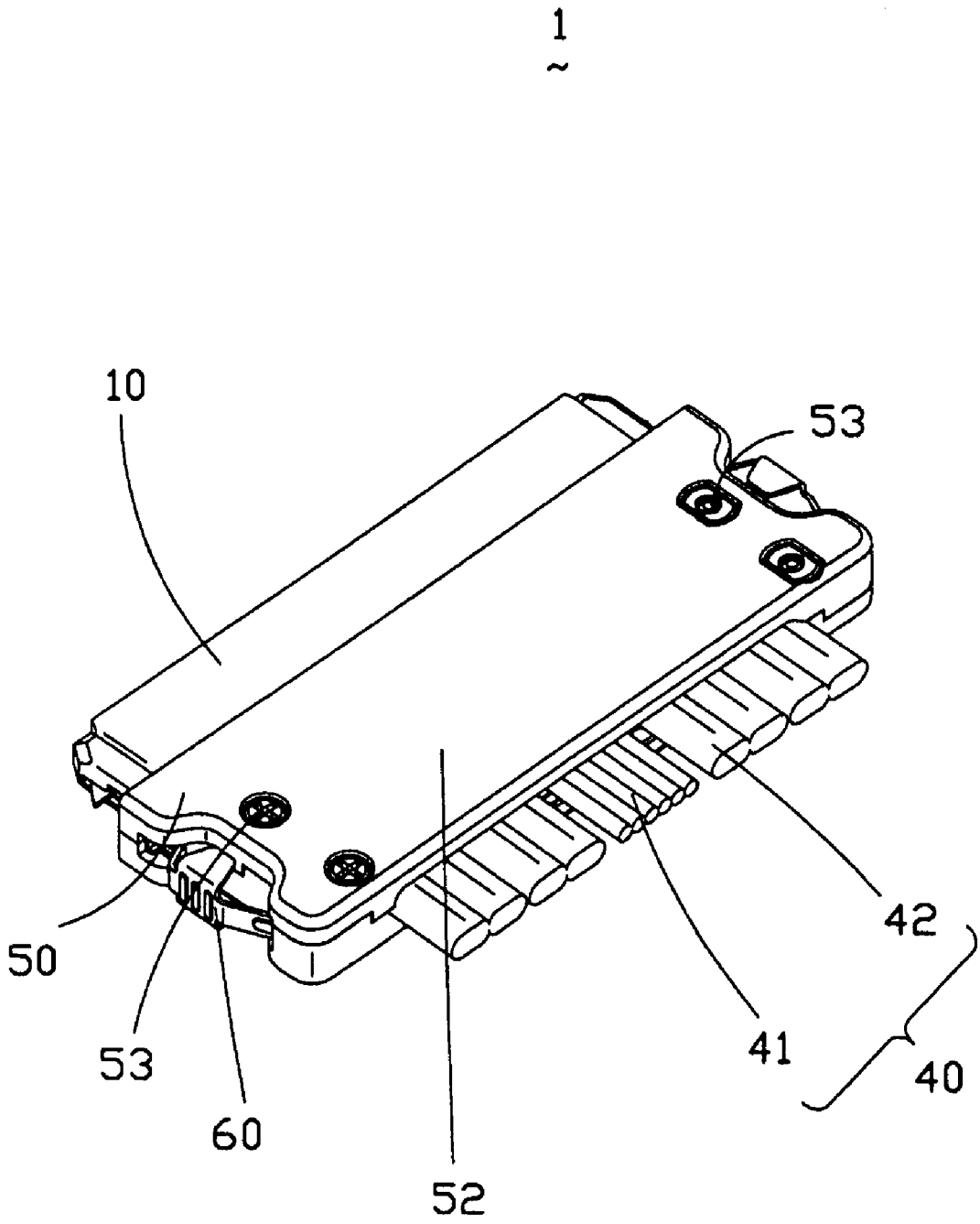
FIG. 4 is a view similar to FIG. 3, but taken from a different aspect.
Figure 5:
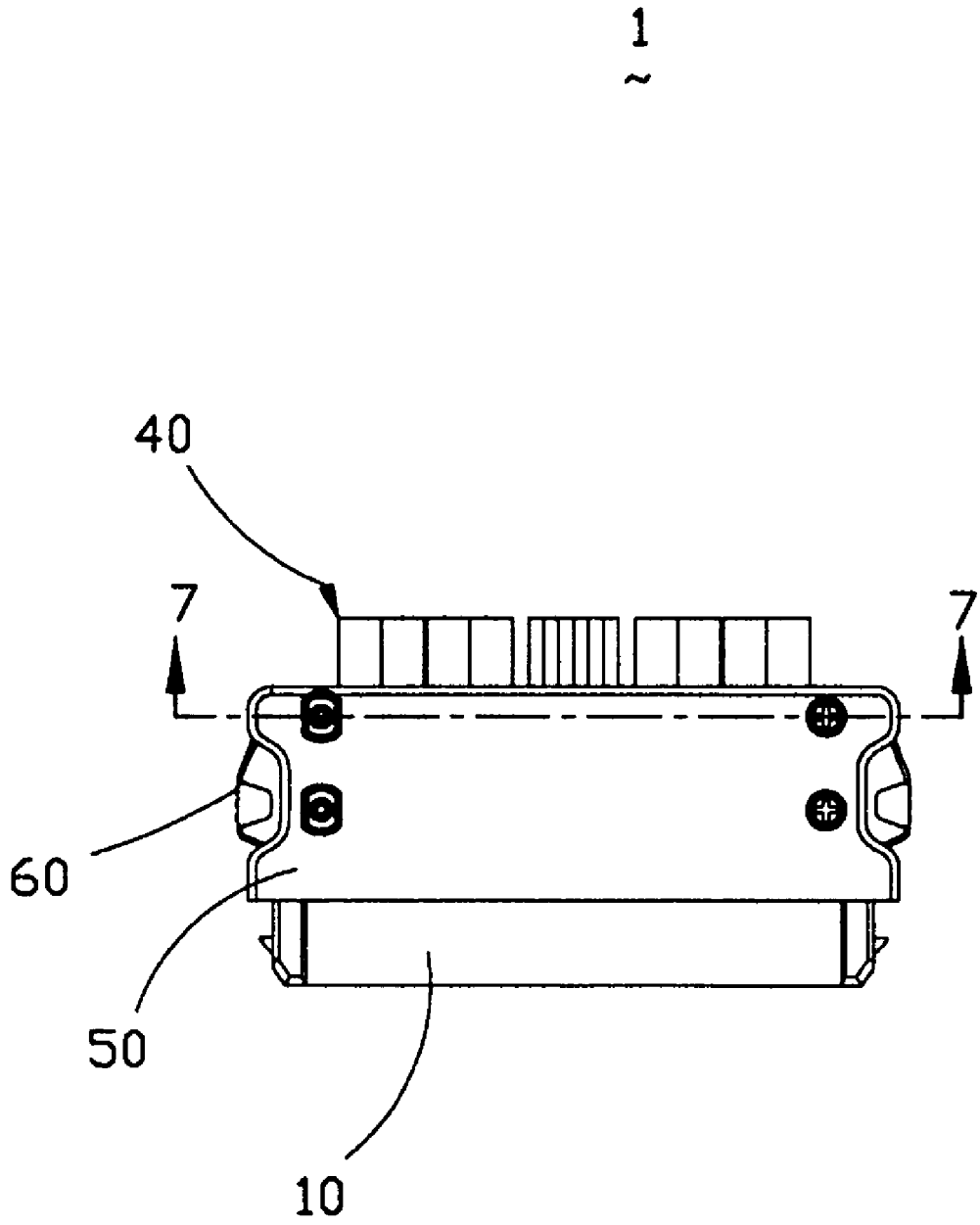
FIG. 5 is a top view of the cable end connector assembly.
Figure 6:
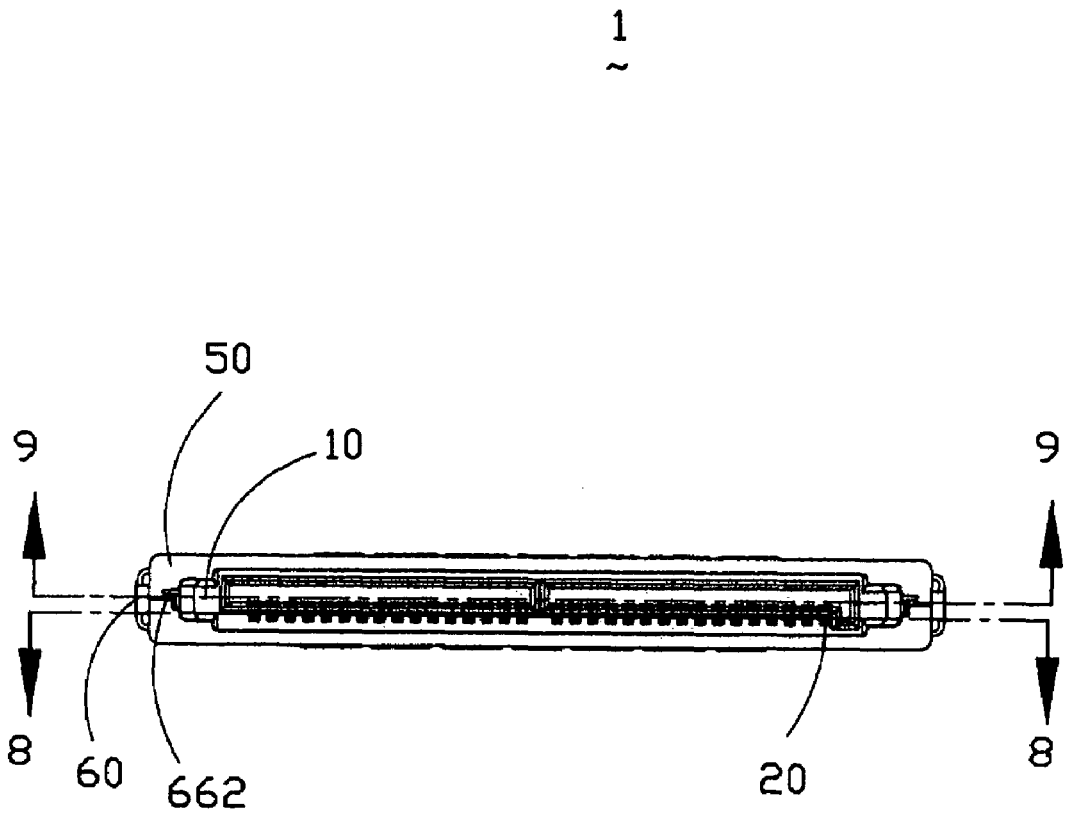
FIG. 6 is a front view of the cable end connector assembly.

Particularly referring to FIGS. 1 and 2, the insulative housing 10 comprises an upper wall 100, a lower wall 101 opposite to the upper wall 100, and a pair of side portions 102 connecting with the upper wall 100 and the lower wall 101. Between the upper and the lower walls 100, 101, the housing 10 defines a plug receiving space 103 and a spacer receiving space 104 for respectively receiving a complementary connector (not shown) and the spacer 30. A block 105 is formed on the upper wall 100 and protrudes into the plug receiving space 103. The block 105 defines a plurality of passageways 106 extending therethrough and communicating with the plug receiving space 103 and the spacer receiving space 104. The plug receiving space 103 is divided into an L-shaped first port 108 and a rectangular second port 109 by a vertically extended partition wall (not labeled) for receiving complementary connectors with different profiles. Each side portion 102 defines a retention cavity 111 therein for engaging with the locking member 60. A baffle 112 is provided on a rear face of the housing 10.

Referring to FIGS. 1 and 2, the contacts 20 are received in the passageways 106 of the insulative housing 10 and each contact comprises a contact portion 21, a tail portion 22 and a housing retaining portion 23 connecting the contact portion 21 and the tail portion 22. The contact portions 21 extend into the L-shaped first port 108 and the rectangular second port 109 of the plug receiving space 103 of the housing 10, respectively. The housing retaining portions 23 are secured within the passageways 106 of the housing 10 by an interference fit. The spacer 30 is mounted to a rear end of the insulative housing 10, and comprises a plurality of through holes 31 for allowing the tail portions 21 of the contacts 20 extending therethrough. The spacer 30 can prevent plastic from entering into the passageways 106 of the insulative housing 10 of the cover 50. The contacts 20 and the spacer 30 can be integrally formed before mounting to the insulative housing 10, if desired.

The cables 40 comprise a pair of first 4-lane cables 41 and a second flat ribbon cable 42 located between the 4-lane cables. The second cable 42 is divided into two groups. The first cable 41 and the second cable 42 are respectively designed to transit high-speed signal and low-speed sideband signal. Each cable 40 comprises a plurality of conductors 43,44 exposed outside and extending towards the spacer 30 for being soldered to corresponding tail portions 22 of the contacts 20.

The insulator 70 is insert-molded on the cables 40 and received in the covers 50.

Referring to FIGS. 1, 2, and 7-9, the cover 50 comprises an upper cover 51 and a lower cover 52 in mirror with the upper cover 51. The upper cover 51 comprises a body portion 510 and two side portions 511 formed at the opposite sides of the body portion 510. Each side portion 511 is separated from the body portion 510 by a beam 512, and comprises a U-shaped receiving cavity 513. The beam 512 comprises a plurality of projecting portions 514 and a plurality of holes 515 alternately disposed along a front-to-back direction. During assembly, each projecting portion 514 of lower cover is extending into the hole 515 of the upper cover, meantime, each projecting portion 514 of upper cover is extending into the hole 515 of the low cover. The upper cover 51 and the lower cover 52 are retained with each other in a plurality of screws 53. The screws 53 are inserted through the holes 515 on the upper and lower cover 51, 52 respectively, and into corresponding projecting portions 514, respectively. The U-shaped receiving cavity 513 on the upper cover 51 and the lower cover 52 together define a second retention cavity 55 communicating with the first retention cavity 111 of the insulative housing 10 along the front-to-back direction.

Figure 10:
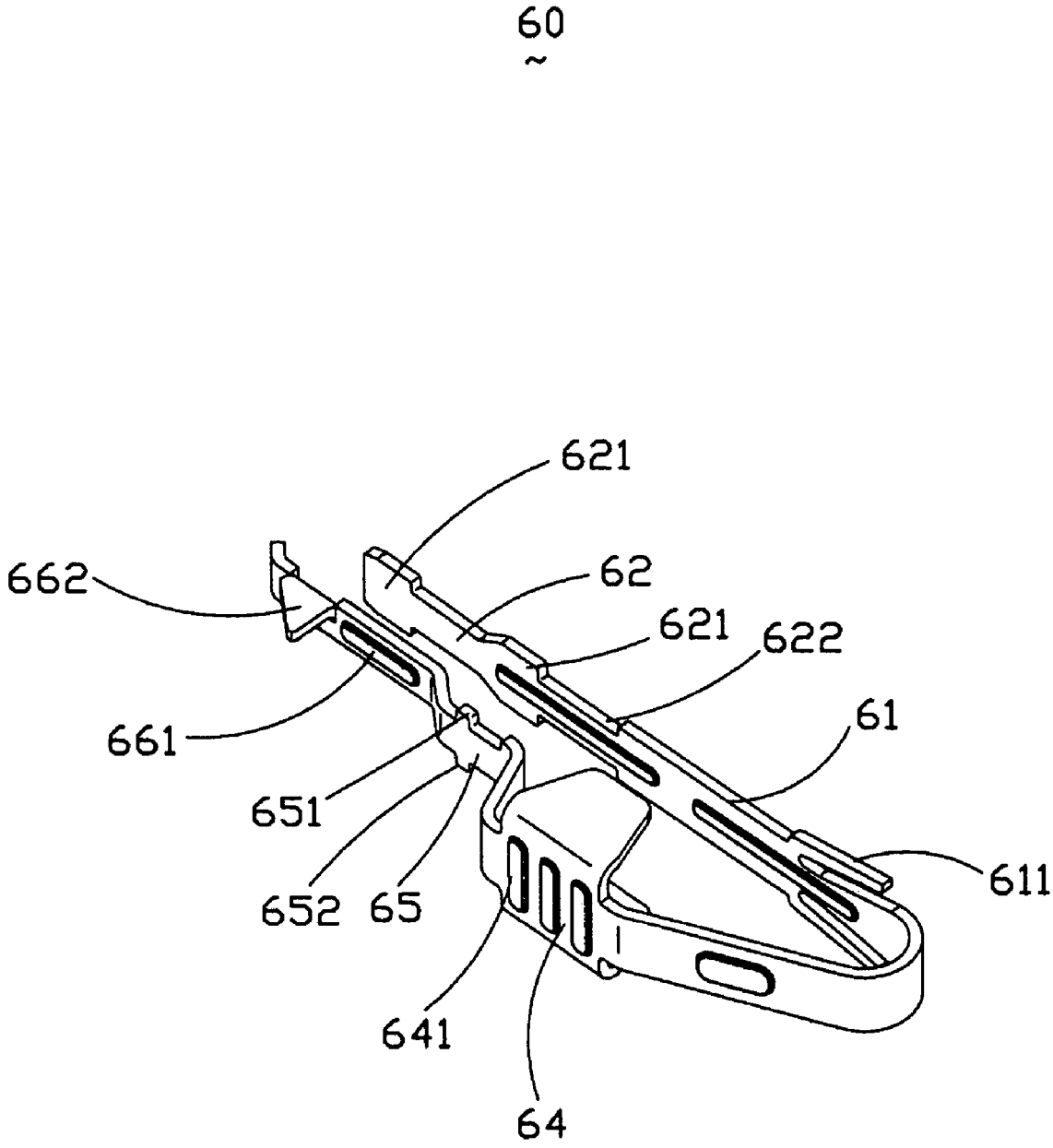
FIG. 10 is an enlarged view of a locking member shown in FIG. 1.
Figure 11:
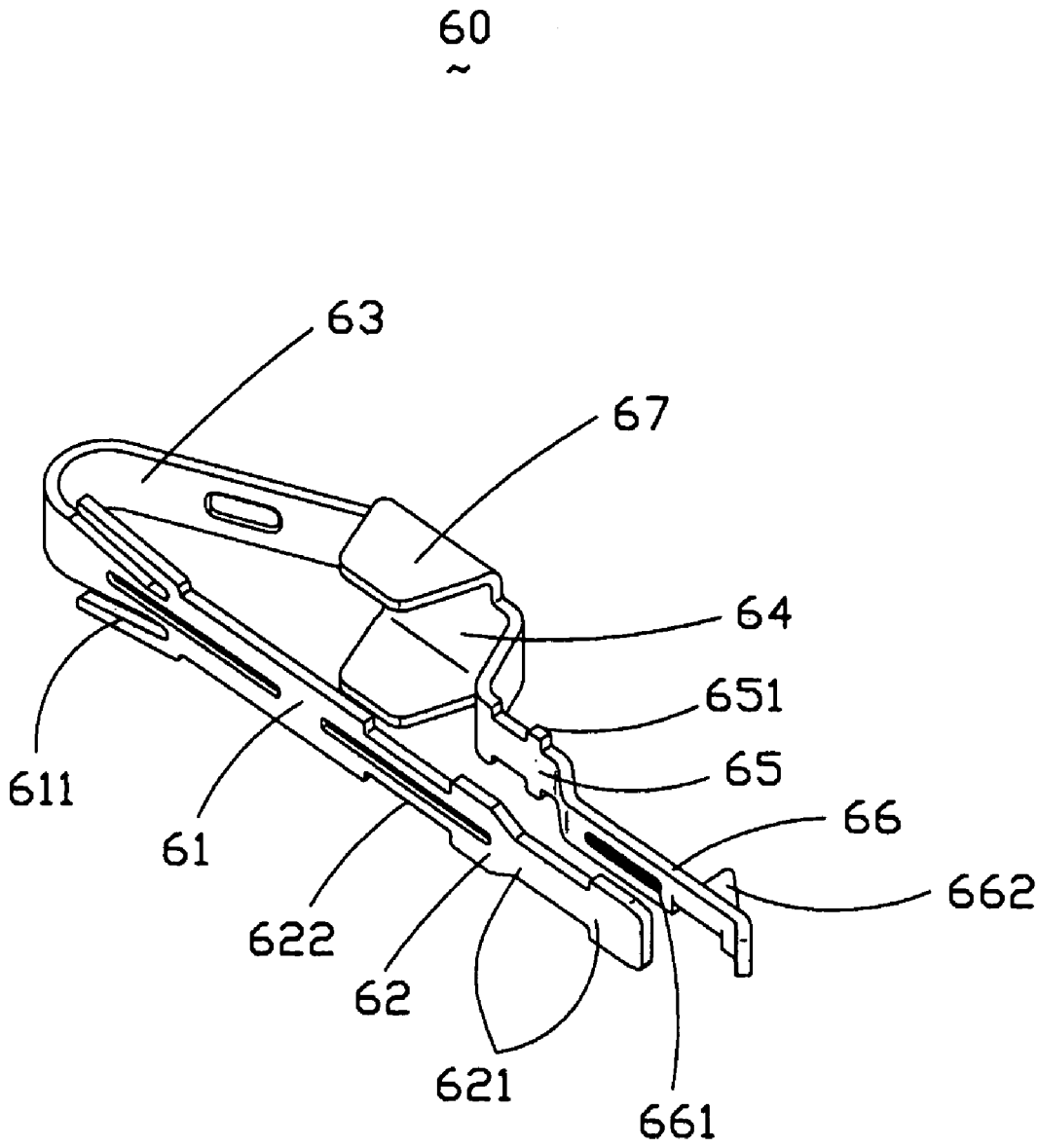
FIG. 11 is a view similar to FIG. 5, but taken from a different aspect.

Referring to FIGS. 10 and 11, each locking member 60 is stamped and formed from a metallic plate and comprises an elongate, housing retention section 62 extending along the front-to-back direction, a cover retention section 61 extending rearwardly from the housing retention section 62, a spring section 63 extending slantways from the cover retention section 61, a flat pushing section 64 extending forwardly from the spring section 63, an L-shaped positioning section 65 extending forwardly from the pushing section 64, and a latch section 66 extending forwardly from the positioning section 65. The housing retention section 62 are partially cut to form two pairs of recesses 622, thus also forms a pair of retention tabs 621 at middle and a tip end thereof. The cover retention section 61 defines a pair of retention tabs 611 slantways extending from opposite upper and lower edges thereof for engaging with the cover 50. The pushing section 64 defines a plurality of protrusions 641 on an outer surface thereof. A pair of stopping section 67 extends towards to the cover retention section 61 from opposite sides of the pushing section 64. The positioning section 65 comprises a pair of positioning tabs 651 and a pair of recesses 652 for assuring fixed assembly. The latch section 66 comprises a protrusion 661 and a locking tab 662 bent and extending outwardly.

Figure 7:
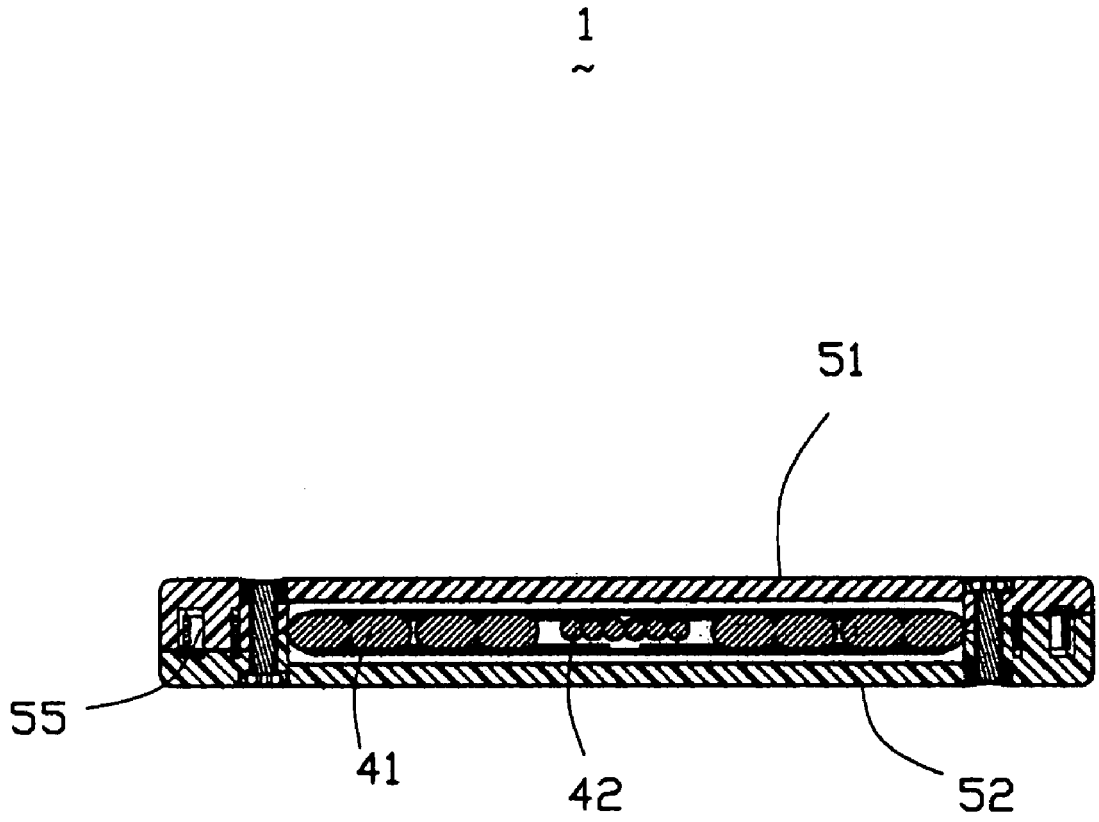
FIG. 7 is a cross-sectional view taken along line 5-5 of FIG. 5.
Figure 8:
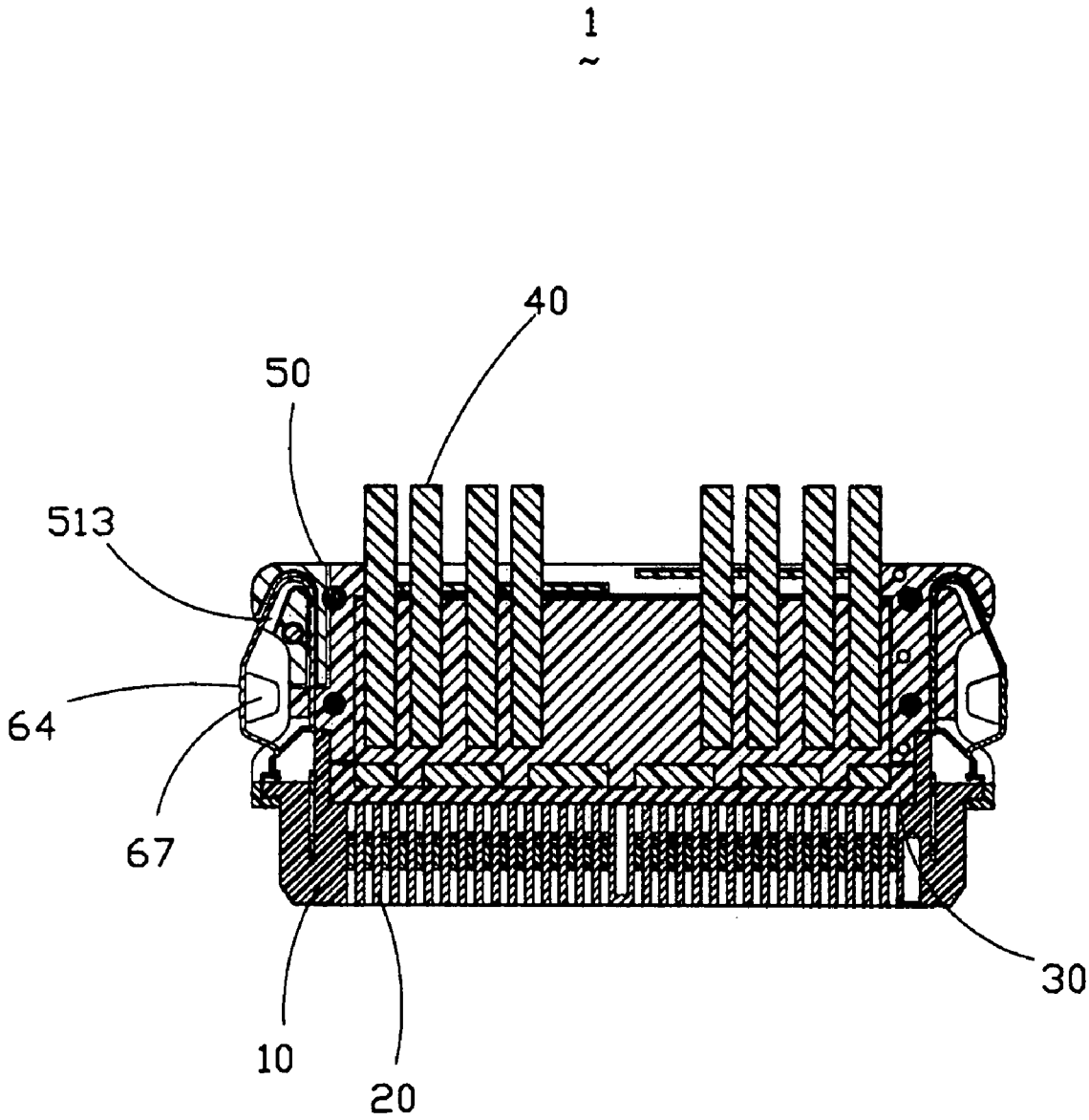
FIG. 8 is a cross-sectional view taken along line 6-6 of FIG. 4
Figure 9:
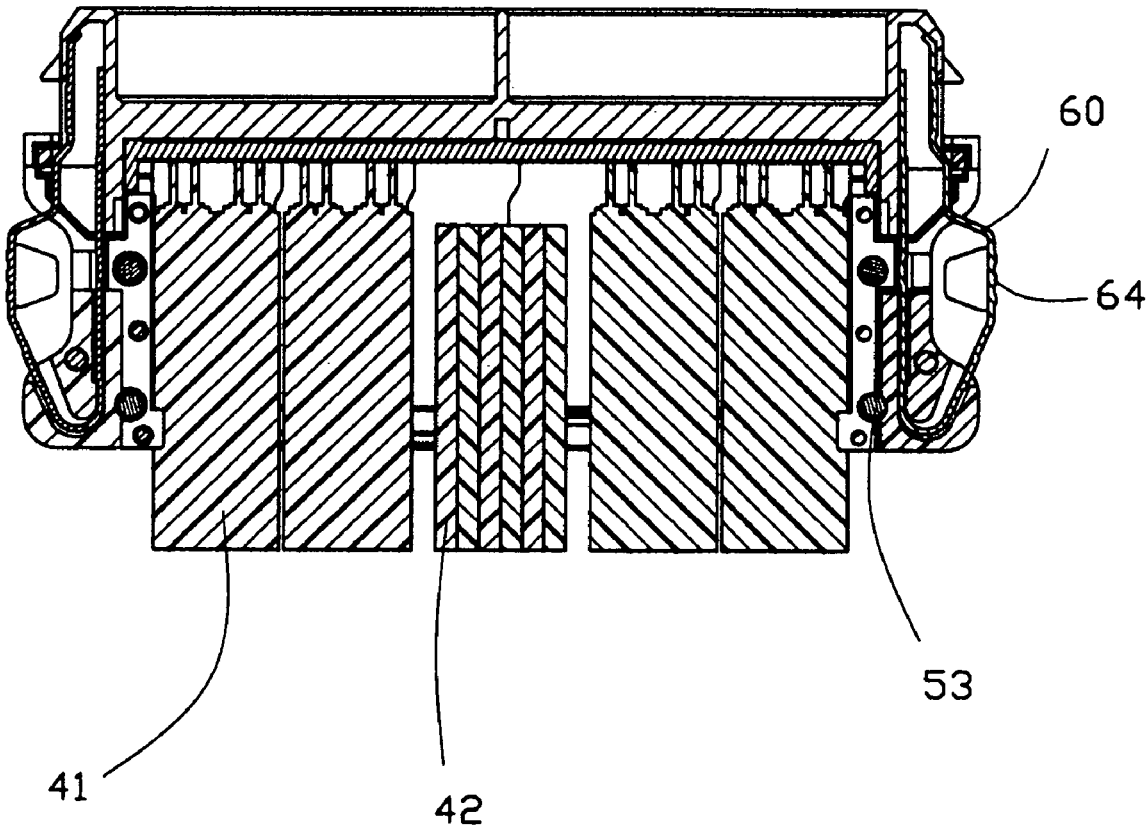
FIG. 9 is a cross-sectional view taken along line 6-6 of FIG.

Referring to FIGS. 7 to 9, in assembly, the housing retention section 62 is received in the first retention cavity 111 of the housing 10 with the retention tabs 621 being engaged therein. The cover retention section 61 received in the second retention cavity 55 of the cover 50 with the retention tabs 61 extending to and securely retained in the cover 50. The pushing section 64 and the stopping section 67 are located in the depression (not labeled) of the cover 50, and the stopping section 67 extends towards the cover 50. The latch section 66 is received in the first retention cavity 111 of the housing 10 and the locking tab 662 projects outside the housing 10. When the cable end connector assembly 1 mates with the complementary connector, an inward pressing force is firstly exerted on the pushing sections 64 of the locking members 60 by user's fingers to drive the latch section 66 to move inwardly. Once the pressing force is released, the latch section 66 restore to its original position due to their own elasticity and thus locks with the complementary connector through the locking tab 622. The positioning tabs 651 of the positioning section 65 abut against the baffle 112 of the housing 10 for assuring a reliable mating between the cable end connector assembly 1 and the complementary connector. When the cable end connector assembly 1 is to be disengaged from the complementary connector, a contrary operating procedure is applied.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A cable end connector assembly for mating with a complementary connector, comprising:

an insulative housing defining a forwardly extending mating port with a pair of opposite side portions by two sides thereof, each of said side portions defining a first retention cavity;

a plurality of contacts disposed in the housing;

a plurality of rearwardly extending cables including a plurality of conductors connected to a rear portion of the housing;

a pair of covers assembled on the rear portion of the housing and enclosing front portions of the cables together, and defining a pair of opposite side portions with a pair of U-shaped second retention cavities located in a horizontal plane therein, respectively, the first retention cavities aligned with the corresponding second retention cavities in a front-to-back direction; and a pair of locking members received in the second retention cavities of the covers and extending into the first retention cavities of the housing, each locking members comprising a spring section and a latching section, the spring section is movably received in the second retention cavities;

wherein the covers are engaged together by a plurality of screws.

2. The cable end connector assembly as described in claim 1, further comprising an insulator being insert-molded on the cables and received in the covers.

3. The cable end connector assembly as described in claim 1, wherein the covers comprise an upper cover and a lower cover in mirror with the upper cover.

4. The cable end connector assembly as described in claim 3, wherein the upper and the lower cover is assembled on the housing along a vertical direction perpendicular to the front-to-back direction.

5. The cable end connector assembly as described in claim 4, wherein the upper cover comprises a body portion, and two side portions are formed at the opposite sides of the body portion, each side portion is separated from the body portion by a beam, and comprises a U-shaped receiving cavity, the lower cover has a structure same as that of the upper cover, the receiving cavities on the upper cover and lower cover are formed said second retention cavities.

6. The cable end connector assembly as described in claim 5, wherein each beam comprises a plurality of projecting portions and a plurality of holes alternately disposed along a front-to-back direction, when the upper cover is assembled to the lower cover, each projecting portion of lower cover is extending into the hole of the upper cover, meantime, each projecting portion of upper cover is extending into the hole of the low cover.

7. The cable end connector assembly as described in claim 6, wherein said screws are inserted through the holes on the upper and lower covers respectively, and into corresponding projecting portions on the upper and lower covers, respectively.

8. The cable end connector assembly as described in claim 1, wherein each locking member comprises at one end thereof a housing retention section retaining in the housing, a cover retention section extending from the housing retention section and retaining in the cover, said spring section extending from the cover retention section, a pushing section extending from the spring section and said latch section at another end thereof for locking with a complementary connector.

9. The cable end connector assembly as described in claim 1, wherein the cables comprise at least a first cable and at least a second cable transmitting different types of signal.

10. The cable end connector assembly as described in claim 1, further comprises a spacer mounted on a rear end of the housing.

11. The cable end connector assembly as described in claim 1, wherein the housing defines a receiving space therein and a partition wall extending along a longitudinal direction, the receiving space is divided by the partition wall into two ports.

12. The cable end connector assembly as described in claim 11, wherein one of the two ports of the housing is L-shaped.

13. A cable connector assembly comprising:

an insulative housing with a plurality of terminals therein;

a cover device including top and bottom covers sandwiching said housing therebetween in vertical direction; and a pair of latches located on two sides of the cover device, each of said latches including a securing section sandwiched between said top and bottom covers in said vertical direction, and a resilient section exposed to an exterior; wherein said top cover and said bottom cover are identical to each other, and fastened to each other by a pair of screws which extend from opposite directions vertically.

14. The cable connector assembly as claimed in claim 13, wherein a pair of U-shaped cavities located at two opposite ends, and said pair of latches respectively partially received in the corresponding cavities.

15. The cable connector assembly as claimed in claim 13, wherein the cover device defines two lateral sides each being equipped with a notch, and the corresponding latch includes a stopper moveable received in the notch.

16. A cable connector assembly comprising:

an insulative housing with a plurality of terminals therein;

a cover device including top and bottom covers sandwiching said housing therebetween in a vertical direction; and a pair of latches located on two sides of the cover device, each of said latches including an inner securing section sandwiched between said top and bottom covers in said vertical direction, and an outer resilient section linked to the inner securing section via a bridge section and exposed to an exterior, said resilient section including a pushing section in a middle region and a locking tab at a front region thereof; wherein the cover device defines two lateral sides each being equipped with a notch, and the pushing section includes a stopper laterally moveably received in the notch and adapted to abut against the corresponding lateral side of the cover device when the pushing section is inwardly pressed to move corresponding locking tab inwardly.

* * * * *